US005274883A

United States Patent [19]

Eke

[11] Patent Number: 5,274,883

[45] Date of Patent: Jan. 4, 1994

[54] CARDING APPARATUS WITH DRAFTING AND AUTOLEVER DEVICE

[75] Inventor: James W. Eke, Accrington, United Kingdom

[73] Assignee: Hollingsworth (U.K.) Limited, Lancashire, United Kingdom

[21] Appl. No.: 980,864

[22] Filed: Nov. 24, 1992

[30] Foreign Application Priority Data

Nov. 26, 1991 [GB] United Kingdom ..... 9125094
Jun. 18, 1992 [GB] United Kingdom ..... 9213074

[51] Int. Cl.[5] ..... D01B 3/04; D01H 5/00

[52] U.S. Cl. ..... 19/106 R; 19/65 A; 19/236; 19/239; 19/286

[58] Field of Search ..... 19/65

[56] References Cited

U.S. PATENT DOCUMENTS

| | | | |
|---|---|---|---|
| 3,003,195 | 10/1961 | Varga | 19/67 |
| 3,384,933 | 5/1968 | Yamamoto et al. | 19/65 A X |
| 3,409,947 | 11/1968 | Whitehurst | 19/236 |
| 3,862,473 | 1/1975 | Felix et al. | 19/240 |
| 4,267,620 | 5/1981 | Allen, Jr. | 19/239 |
| 4,512,061 | 4/1985 | Hartmannsgruber et al. | 19/239 |
| 4,539,729 | 9/1985 | Meile et al. | 19/286 X |
| 5,007,136 | 4/1991 | Artzt et al. | 19/65 A |
| 5,018,248 | 5/1991 | Haworth et al. | 19/239 X |
| 5,152,033 | 10/1992 | White | 19/106 R X |

FOREIGN PATENT DOCUMENTS

| | | | |
|---|---|---|---|
| 2113140 | 9/1972 | Fed. Rep. of Germany . | |
| 2164564 | 8/1973 | France . | |
| 613478 | 9/1979 | Switzerland . | |
| 734820 | 8/1955 | United Kingdom . | |
| 941405 | 11/1963 | United Kingdom . | |
| 1131069 | 10/1968 | United Kingdom . | |
| 1135752 | 12/1968 | United Kingdom . | |
| 2056513 | 3/1981 | United Kingdom | 19/106 R |
| 2062704 | 5/1981 | United Kingdom | 19/239 |
| 2221669 | 2/1990 | United Kingdom . | |
| 2235472 | 3/1991 | United Kingdom | 19/106 R |

*Primary Examiner*—Clifford D. Crowder
*Assistant Examiner*—John J. Calvert
*Attorney, Agent, or Firm*—Leatherwood Walker Todd & Mann

[57] ABSTRACT

A sliver is created by directly condensing the carded web from a carding apparatus and then feeding it to a drafting set from which it is subsequently delivered by way of an autoleveller comprising sliver thickness sensing means and variable draft means.

7 Claims, 1 Drawing Sheet

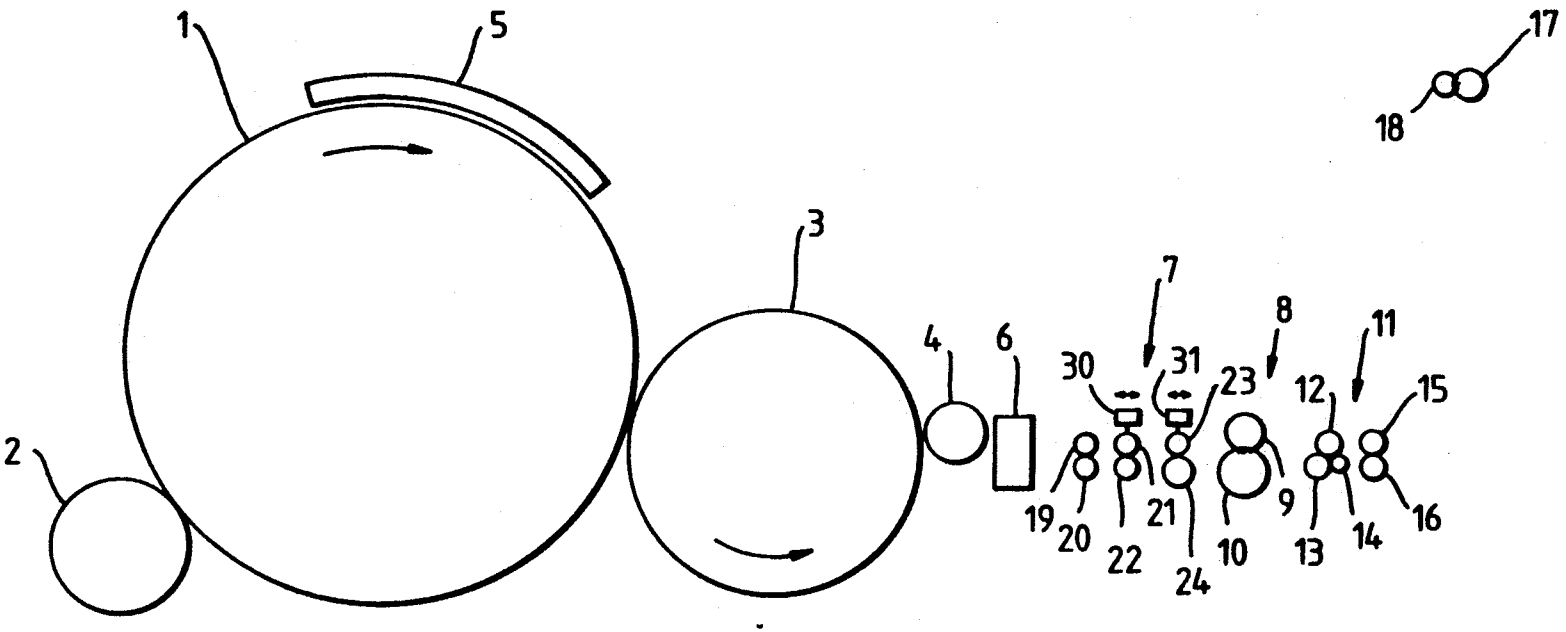
1
2
3
4
5
6
7
8
9
10
11
12
13
14
15
16
17
18
19
20
21
22
23
24
30
31

CARDING APPARATUS WITH DRAFTING AND AUTOLEVER DEVICE

BACKGROUND OF THE INVENTION

The present invention relates to an improved carding apparatus in which the standard of the sliver produced is good enough to allow the sliver to be fed directly to a spinning operation or to a combing operation without the need for further doubling and drafting.

PRIOR ART

It is known to provide carding apparatus having an autoleveller which reduces the irregularities in density or thickness of the product sliver. Autolevellers can operate to reduce either long term fluctuation which may involve wavelengths which extend over many metres of length of the finished sliver due to variations in the input material, or may compensate for much shorter term fluctuations involving fractions of a metre in wave length. The present invention is particularly applicable to a short term autoleveller on carding apparatus, although it is conceivable to combine both short term and long term autolevelling if desired.

An autoleveller relies on varying the draft of a sliver just downstream of a sliver density or thickness measuring sensor so that the variations sensed by that sensor can be eliminated by increasing the draft temporarily to reduce sliver thickness or density or by reducing the draft ratio temporarily to increase the density or thickness.

OBJECT OF THE INVENTION

It is an object of the present invention to improve still further on the quality of the sliver produced from a short term autoleveller incorporated in or downstream of carding apparatus.

SUMMARY OF THE INVENTION

Accordingly, one aspect of the present invention provides a process of carding a fibrous web to form a sliver, comprising carding the web, and then immediately condensing the carded web to form a sliver and subjecting the thus formed sliver to an initial drafting operation and then autolevelling the thus drafted sliver downstream of the point of completion of the initial drafting operation.

A second aspect of the present invention provides carding apparatus comprising means for condensing the carded web to form a sliver, a drafting set operative to draft the thus condensed sliver, and downstream of the drafting set an autoleveller including variable draft means for autolevelling the drafted sliver.

BRIEF DESCRIPTION OF THE DRAWING

In order that the present invention may more readily be understood the following description is given, merely by way of example, with reference to the accompanying drawing in which the sole FIGURE shows one embodiment of 9- drafting/carding apparatus in accordance with the invention.

DETAILED DESCRIPTION OF THE PREFERRED EMBODIMENT

Referring now to the drawing, there is shown a carding cylinder 1 to which a fibrous web or batt is introduced by a taker-in 2, and from which the carded web is removed by means of a doffer 3. The web is then in turn removed from the doffer 3 by a web take-off roll 4. The carding of fibres being carried by the carding cylinder 1 is effected by way of card clothing on a concave part-cylindrical carding plate 5 which is thus held close to the path of movement of card clothing on the cylinder 1, so that the web being carried by the cylinder 1 is carded between the opposed points of (i) the card clothing of the cylinder 1 and (ii) that on the plate 5, respectively.

In a known manner, the web removed by the take-off roll 4 is then applied to a conveyor belt web condensing system 6 which draws the edges of the web inwardly towards the centre of the web in order to condense the web to form a sliver.

Other forms of web condensing apparatus are known and are suitable for the present invention, such apparatus including a lateral draw belt take-off arrangement in which the sliver is condensed along one edge of the web rather than along the centre of the web, or a condensing trumpet arrangement in which the edges of the web are progressively brought inwardly to the centre to be condensed to form a sliver. However, the centre draw conveyor belt arrangement mentioned above is preferred.

In EP-A-0354653 the sliver from the belt take-up condensing system is passed between tongue-and-groove rollers of the autoleveller, to a "two over three" roller drafting system. However, in the present apparatus the sliver is first of all passed through a "three over three" drafting set 7 from which it then passes between a tongue-and-groove roller pair 8 comprising an upper tongue roller 9 whose periphery engages in a groove of a lower groove roller 10.

From the tongue-and-groove roller pair 8 the sliver then passes through a "two over three" drafting roller set 11 comprising a first nip defined by upper roller 12 engaging lower rollers 13 and 14 to clamp the sliver thereagainst, and a second drafting nip comprising an upper drafting roll 15 and a lower drafting roll 16.

From the final drafting pair 15, 16 the sliver is then fed by way of a coiler into a sliver can for storage purposes. However, as indicated above, the material could if desired be fed straight to a comber or to a spinning stage such as an open-end spinning machine without needing to be stored in a can.

In the preferred embodiment of the present invention where the sliver is stored before further processing, the coiler includes a further tongue-and-groove roller pair comprising a groove roller 17 whose groove is engaged by the periphery of a tongue roller 18, for the purposes of monitoring the uniformity of the sliver passing into the can at the coiler.

Both the tongue-and-groove roller pair 8 and the tongue-and-groove rollers 17 and 18 of the coiler are, as is conventional, arranged so that one, for example the tongue roller 9 or 18, can be yieldably displaced towards and away from the other (the groove roller 10 or 17) with means for sensing the changes in spacing between the axes of the tongue-and-groove rollers of the respective pairs in order to detect variations in thickness of the sliver passing between the tongue-and-groove rollers. The displacement sensor provides a signal to indicate sliver thickness, and in the case of the tongue-and-groove roller pair 8 this signal is used to vary the draft in the drafting set 11, but in the case of the tongue-and-groove rollers 18 and 17 the displacement signal is intended to provide a monitor of sliver uniformity, for the purposes of rejecting any sliver whose quality is out of limits when passing through the coiler. In practice, however, the reliability of the uniformity imparted by the apparatus shown in the drawing is such that this sliver thickness monitoring at the rollers 17 and 18 is simply a guarantee of uniformity and not a positive rejection mechanism.

In the first "three over three" drafting roller set 7, the first pair of drafting rollers 19 and 20 are fixed in position, whereas means 30 are provided for moving the second pair of drafting rollers 21 and 22 as a pair towards and away from the first pair 19, 20, in order to adjust the length of the "breaking draft" zone between them to accommodate different lengths of fibre staple length. Similarly, means 31 are provided for moving the third pair of drafting rollers 23, 24 adjustable for positioning towards and away from the second pair 21, 22 for varying the length of the "actual draft" zone between rollers 21, 22 on the one hand and rollers 23, 24 on the other hand.

We prefer the draft imposed at the autolevelling stage in the "two over three" drafting roller set 11 to be of the order of 1.5 in the steady state, but varied by increasing and decreasing the draft in order to restore sliver thickness uniformity. A more preferable draft at the drafting set 11 may be of the order of 1.3:1 in order to improve the autolevelling efficiency. The draft required at the autolevelling stage is simply enough to ensure that there is adequate scope for draft reduction to eliminate variations of the maximum amplitude likely to be encountered. It is not intended that there should be any strong drafting action at the drafting set 11.

At the drafting set 7, the overall draft may be as high as 30, although the draft value may be chosen depending on the next stage of treatment of the sliver leaving the autoleveller final drafting nip 15, 16. Higher drafts, for example of the order of 16:1, may be preferred where the sliver is to be subjected to a downstream combing operation, but if direct feed of the sliver to an open-end spinner is sought after then an overall draft of the order of 12:1 at the drafting set 7 is preferred.

For optimum overall quality of the sliver a draft of from 6:1 to 8:1 is preferred.

I claim:

1. A process of carding a fibrous web to form a sliver on a single processing machine, comprising the steps of:

carding the web with a card;

removing the web from the card;

then immediately condensing the carded web to form a sliver;

subjecting the thus formed sliver to an initial drafting operation immediately after condensing the carded web into a sliver;

measuring the thickness of the sliver leaving the initial drafting operation; and then short term autolevelling the thus drafted and measured sliver downstream of the measuring point dependent on the measured thickness of the sliver.

2. A process according to claim 1, comprising feeding the autolevelled sliver to a storage can be way of a coiler.

3. A carding apparatus for producing a carded web and sliver on a single processing machine, the carding apparatus comprising:

carding means for forming a carded web from fibers;

doffing means adjacent said carding means for removing the carded web from said carding means;

condensing means downstream of said doffing means for receiving and condensing a carded web from said carding means to form a sliver;

first drafting means adjacent to and downstream of said condensing means having at least one drafting nip operative to draft the thus condensed sliver;

an autoleveller downstream of the first drafting means including variable second draft means for drafting the sliver drafted by said first drafting means; and at least one sliver thickness measuring sensor positioned downstream of said first drafting means and upstream of said first variable second draft means for measuring the thickness of the sliver after being drafted by said first drafting means and prior to being drafted by said variable second draft means for sending signals for adjustment of the variable drafting means.

4. A carding apparatus according to claim 3, wherein said variable second draft means includes two drafting rolls being positioned over three drafting rolls, the sliver passing between said two drafting rolls and said three drafting rolls from the first drafting means by way of said sliver thickness measuring sensor.

5. A carding apparatus according to claim 4, wherein said sliver thickness measuring sensor comprises a tongue-and-groove roller pair.

6. A carding apparatus according to claim 3, wherein said web condensing means includes a conveyor belt web condensing unit for directly condensing the carded web and introducing the condensed carded web as a sliver to said first drafting means.

7. A carding apparatus according to claim 3, wherein said first drafting means includes successive drafting nips and means for varying the distance between said successive drafting nips thereof for adjustment to correspond with the staple length of the sliver being formed.

* * * * *